United States Patent [19]

Terayama et al.

[11] Patent Number: 4,832,245

[45] Date of Patent: May 23, 1989

[54] AUTOMATIC NAILING APPARATUS WITH IMPROVED PERCUSSION ROD AND NOSEPIECE

[75] Inventors: Tsunehisa Terayama; Seki Moriguchi; Toshifumi Kubota, all of Katsuta, Japan

[73] Assignee: Hitachi Koki Company, Ltd., Japan

[21] Appl. No.: 143,402

[22] Filed: Jan. 13, 1988

[30] Foreign Application Priority Data

Jan. 14, 1987 [JP] Japan ..... 61-7074

[51] Int. Cl.[4] ..... B25C 1/04

[52] U.S. Cl. ..... 227/130; 227/119

[58] Field of Search ..... 227/119, 120, 130, 139

[56] References Cited

U.S. PATENT DOCUMENTS

| | | | |
|---|---|---|---|
| 2,640,985 | 6/1953 | Bygbjerg | 227/120 |
| 3,708,095 | 1/1973 | Briggs | 227/126 |
| 4,136,810 | 1/1979 | Bull | 227/120 |

*Primary Examiner*—Frank T. Vost
*Assistant Examiner*—James L. Wolfe
*Attorney, Agent, or Firm*—Lowe, Price, LeBlanc, Becker & Shur

[57] ABSTRACT

An automatic nailing apparatus includes a housing having a piston driving system for driving a piston, a percussion rod having a concave at only the tip thereof, a nosepiece having a round channel being provided with a pair of nail head guide rails, and a nail magazine for supplying interconnected nails. The forefront nail of the interconnected nails can be nailed in a direction normal to a workpiece because a point of application on nailing exists on the center axis of the forefront nail.

5 Claims, 3 Drawing Sheets

AUTOMATIC NAILING APPARATUS WITH IMPROVED PERCUSSION ROD AND NOSEPIECE

BACKGROUND OF THE INVENTION

1. Field of the Invention

This invention relates generally to fastener driving devices and particularly to automatic nailing apparatus for driving successive feeding nails from a nail magazine.

2. Prior Art

One example of a conventional fastener driving device is shown in U.S. Pat. No. 3,708,095. The technique disclosed in this patent requires relatively complex structures, and brings about disadvantages as follows. Firstly, since a percussion rod has four square convex portions, a nosepiece for the sliding of the percussion rod is required to be formed of two members due to the difficulty of manufacturing thereof. Meanwhile, the percussion rod is generally made of a round bar because the percussion rod is screwed into a piston. Therefore, the percussion rod having the four square convex portions and one square concave portion is difficult to manufacture. Secondly, since the nail head of the forefront nail of successive feeding nails contacts or hits against only one flat wall surface of a convex portion between two grooves of the channel portion, the nail head is not always placed at a desired position. Therefore, the positioning of the nail head is unstable. Thirdly, the maximum width of the lower end surface of the percussion rod in the alignment direction of the successive feeding nails is narrower than the maximum width of the nail head in the same direction, and the point of application when the nail is driven by the percussion rod does not exist on the center axis of the nail shank. Therefore, the nails are apt to be driven with an incline. Fourthly, since the contact area between the lower end surface of the percussion rod and the top surface of the nail head is narrow, the lower surface of the percussion rod is apt to abrade.

SUMMARY OF THE INVENTION

The present invention has been developed in order to remove the above-described drawbacks inherent to the conventional fastener driving device.

It is, therefore, an object of the present invention to provide an automatic nailing apparatus including a long-life percussion rod having a simple structure.

It is another object of the invention to provide an automatic nailing apparatus with which forefront nail of successive feeding nails can be driven in a direction normal to a workpiece.

In accordance with the present invention there is provided an automatic nailing apparatus including a housing having a piston driving means for driving a piston; a percussion member fixed to the piston, the percussion member being provided with a concave at only a tip thereof for preventing a subsequent nail head from being percussed; a nosepiece having a round channel for reciprocating the percussion member and for leading a nail, the nosepiece being provided to the housing; and a nail magazine for supplying interconnected nails to the round channel.

BRIEF DESCRIPTION OF THE DRAWINGS

The object and features of the present invention will become more readily apparent from the following detailed description of the preferred embodiment taken in conjunction with the accompanying drawings in which.

The same or corresponding elements and parts are designated at like reference numerals throughout the drawings.

DETAILED DESCRIPTION OF THE INVENTION

Figure 1:
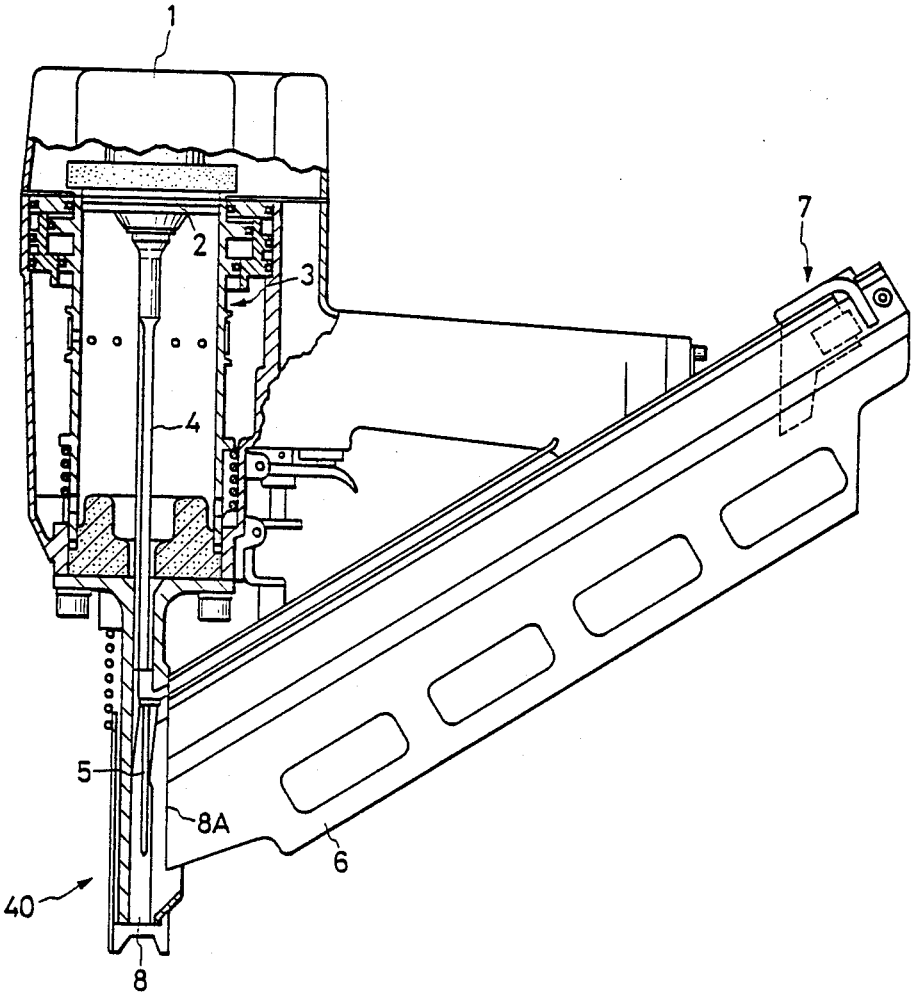
FIG. 1 is a partially sectional view of an automatic nailing apparatus according to the present invention.

Referring to FIG. 1, there is shown a partially sectional view of an automatic nailing apparatus according to an embodiment of the present invention. The automatic nailing apparatus generally comprises a housing 1, a piston 2, a pressure system 3, a percussion rod 4, a nail magazine 6, a nail feeder 7, and a nosepiece 40 including a discharge channel 8 having a nail insertion slot 8A. The nail magazine 6 has interconnected nails which are to be successively fed, and the nail feeder 7 feeds the interconnected nails to the discharge channel 8. The piston 2 is fixedly connected to the percussion rod 4, and is reciprocated by the pressure system 3 provided in the housing 1. When a nail 5 is fed from the nail insertion slot 8A to the discharge channel 8, the nail 5 is percussed by the percussion rod 4 which is reciprocated in the discharge channel 8 so as to be driven into a workpiece. The above is a brief description of the structure and operation of the automatic nailing apparatus of the present invention.

Now the detailed structure of the automatic nailing apparatus will be described hereinbelow with reference to FIGS. 2–8.

Figure 2:
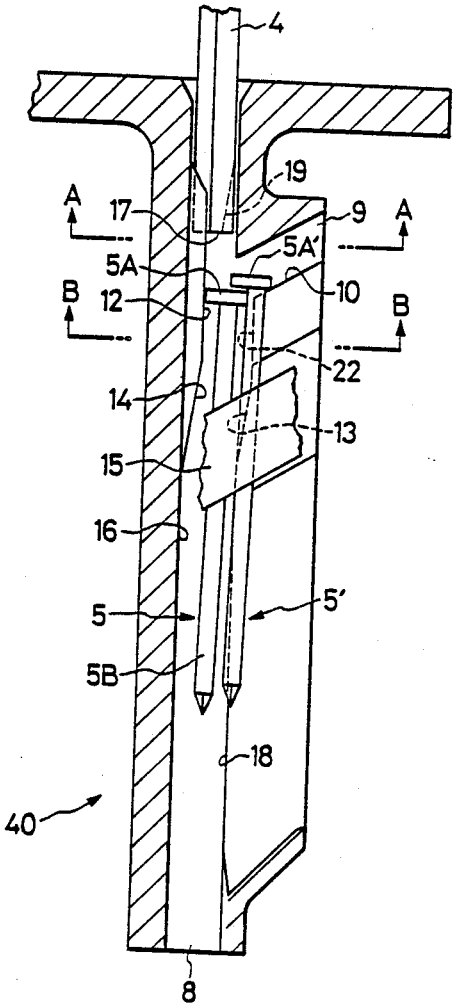
FIG. 2 is an enlarged fragmentary vertical sectional view of a nosepiece of the automatic nailing apparatus according to the present invention.

FIG. 2 is an enlarged fragmentary vertical sectional view of a nosepiece 40 of the automatic nailing apparatus according to the present invention, and shows a state just before the nail head 5A of the nail 5 is percussed by the percussion rod 4. The nail 5 is located forefront in a plurality of nails which are interconnected by an easily cuttable connection band. The nosepiece 40 has a discharge channel 8 and a nail head channel 9 for feeding the nail head 5A, and the nail head channel 9 has a slit 30 for passing a nail shank 5B (see also FIG. 4). A nail head supporting surface 10 is formed at the both sides of the slit 30. The discharge channel 8 has also an arc-shaped wall 16, a pair of percussion rod guide walls 18 each continuous to a cut wall 22 via a slope 13, and a pair of nail head guide rails 12 each having a slope 14 which is parallel to the slope 13 (see also FIGS. 3 and 4).

Figure 3:
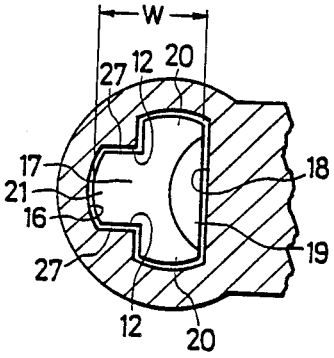
FIG. 3 is a sectional view taken along the line A—A of FIG. 2.
Figure 5:
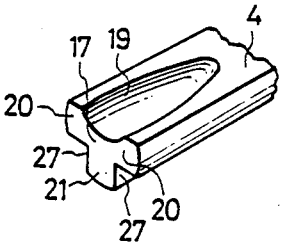
FIG. 5 is a perspective view of the tip end portion of a percussion rod in the automatic nailing apparatus according to the present invention.

The percussion rod 4 has a concave portion or a curved surface 19 for avoiding percussion of the following nail head 5A' when percussing the nail head 5A, three convex portions, i.e. a front guide portion 21, and two side guide portions 20, and two guide grooves 27 as shown in FIG. 5. The concave portion 19 is made in one side surface facing to the insertion slot 8A, and is extending in the longitudinal direction of the percussion rod 4. The depth of the concave portion 19 increases in a direction toward the percussion surface 17 such that the depth at the tip side is larger than the depth at the opposite side. The concave portion 19 has a semi-circular shape to correspond to the arcuate periphery of each nail head when viewed from the percussion surface 17. In order that the percussion rod 4 is reciprocated in the discharge channel 8, each of the guide grooves 27 is engaged with each of the nail head guide rails 12, and the front guide portion 21 is fitted therebetween as shown in FIG. 3. The nail head 5A fed from a nail head channel 9 does not contact an arc-shaped inside wall 16 of the discharge channel 8 owing to the pair of nail head guide rails 12 which is provided to an upper portion of the discharge channel 8. It is to be noted that since the nail 5 is supported by the nail head guide rails 12, the nail head 5A is always placed at the same position even when the interconnected nails are pressed by the nail feeder 7. Besides, the cut wall 22 is provided for avoiding that the nail head 5A of the forefront nail 5 does not catch the nail head supporting surface 10, and is parallel to the nail head guide rails 12. The above-mentioned structure causes the forefront nail 5 to be positioned in the discharge channel 8 in the direction normal to a workpiece when the nail 5 moves downwardly.

Figure 6:
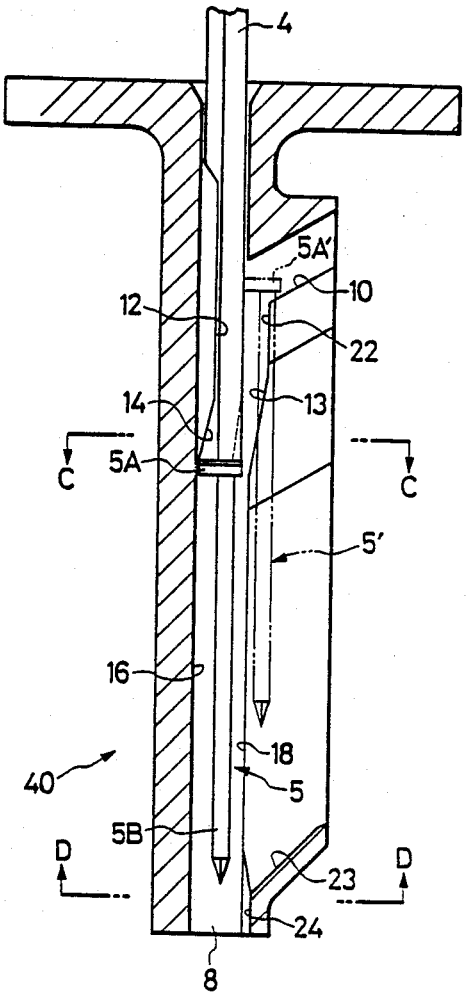
FIG. 6 is a view similar to FIG. 2 showing a nail state just after a forefront nail has been percussed.
Figure 7:
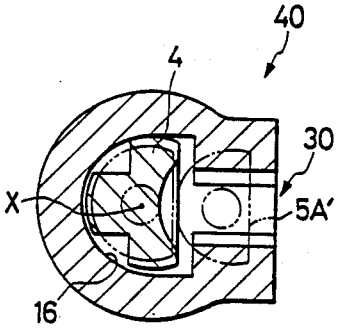
FIG. 7 is a sectional view taken along the line C—C of FIG. 6.

FIG. 6 is an enlarged fragmentary vertical sectional view of the nosepiece 40 of the automatic nailing apparatus according to the present invention, and shows a state just after the nail head 5A of the nail 5 is percussed by the percussion rod 4. As will be seen from FIGS. 6 and 7, the forefront nail 5 which has cut the connection band 15 is moved downwardly, and then the slopes 14 cause the point of application to exist on the center axis of the nail shank 5B of the nail 5 when the nail 5 is driven by the percussion rod 4. The point of application is located on the percussion surface 17, and is defined as a point X equidistant from three arc portions of the convex guide portions 20 and 21. As a result, since bending stress is not generated in the percussion rod 4, the nail 5 is driven in a direction normal to a workpiece.

Figure 4:
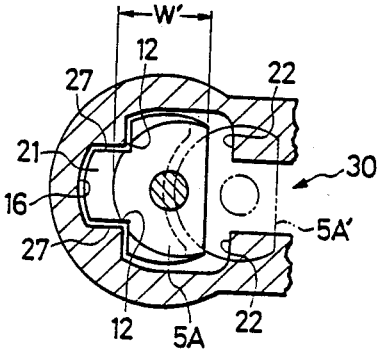
FIG. 4 is a sectional view taken along the line B—B of FIG. 2.

It is to be noted that the curved surface or concave portion 19 is formed at only the end portion of the percussion rod 4. Therefore, the following nail head 5A' does not percuss, and the point of the application when nailing can be adjusted on the center axis of the nail 5. Moreover, as shown in FIGS. 3 and 4, since the width W of the percussion surface 17 is larger than the width W' of the nail head 5A, a contact area between the percussion surface 17 and the nail head 5A is large. Therefore, nail head deformation after driving can be reduced.

Figure 8:
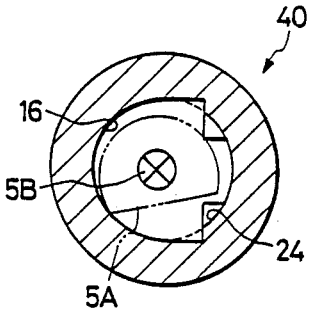
FIG. 8 is a sectional view taken along the line D—D of FIG. 6.

In addition, as shown in FIGS. 6 and 8, since the discharge channel 8 has a guide slope surface 23 and a round opening 24 at the lower portion thereof, if the nail 5 spins, the nail 5 does not hit the guide slope surface 23.

As will be understood from the-above description, the percussion rod 4 is easy to produce from a round bar due to a simple structure, and the forefront nail 5 of successive feeding nails can be driven in the direction normal to a workpiece because the point of application exists on the center axis of the forefront nail 5.

The above-described embodiments are just examples of the present invention, and therefore, it will be apparent for those skilled in the art that many modifications and variations may be made without departing from the scope of the present invention.

What is claimed is:

1. An automatic nailing apparatus comprising:

(a) a housing including a piston driving means for driving a piston;

(b) an elongated percussion member connected to said piston for driving a nail and having a nail driving tip, said percussion member being provided with a concave side surface at only the tip thereof for preventing a head of a subsequent nail from being percussed, said concave surface extending in a longitudinal direction along said percussion member from the tip thereof; the depth of said concave surface increasing in a direction toward said tip such that depth at tip is larger than the depth at a position removed from the tip along said longitudinal direction;

(c) a nosepiece having an inside wall defining a generally round channel therein for guiding said percussion member and said nail, said nosepiece being provided to said housing; and (d) a nail magazine for containing interconnected nails and for supplying each of said nails one after another to said round channel.

2. An automatic nailing apparatus claimed in claimed 1, wherein said round channel includes a pair of guide rails for stably positioning said nail.

3. An automatic nailing apparatus claimed in claimed 2, wherein said percussion member is arranged such that two grooves are made therein to be engaged with said pair of guide rails.

4. An automatic nailing apparatus claimed in claim 2, wherein each of said guide rails has a slope for guiding said nail to the inside wall of said round channel.

5. An automatic nailing apparatus claimed in claim 1, wherein the maximum width of said percussion member in the nail feeding direction is larger than the maximum width of said nail in the same direction.

* * * * *

UNITED STATES PATENT AND TRADEMARK OFFICE

CERTIFICATE OF CORRECTION

PATENT NO. : 4,832,245

DATED : May 23, 1989

INVENTOR(S) : Tsunehisa TERAYAMA et al.

It is certified that error appears in the above-identified patent and that said Letters Patent is hereby corrected as shown below:

Title page:

Foreign Application Priority Data should be changed from "Japan 61-7074" to --Japan 62-7074--.

Signed and Sealed this

Sixth Day of February, 1990

*Attest:*

JEFFREY M. SAMUELS

*Attesting Officer*

*Acting Commissioner of Patents and Trademarks*